United States Patent [19]

Goerner

[11] Patent Number: 4,951,900

[45] Date of Patent: Aug. 28, 1990

[54] CORE LOADING DEVICE FOR WEB-SLITTING MACHINES

[75] Inventor: Bernd Goerner, Baden-Wurttemberg, Fed. Rep. of Germany

[73] Assignee: Beloit Corporation, Beloit, Wis.

[21] Appl. No.: 296,544

[22] Filed: Jan. 12, 1989

[30] Foreign Application Priority Data

Jan. 13, 1988 [DE] Fed. Rep. of Germany ..... 3800702

[51] Int. Cl.[5] ..... B65H 54/88; B65H 18/08

[52] U.S. Cl. ..... 242/56.2; 242/68.4

[58] Field of Search ..... 242/35.5 A, 55, 56 R, 242/56 A, 56.1–56.9, 65, 66, 68.4

[56] References Cited

U.S. PATENT DOCUMENTS 4,299,358 11/1981 Dropczynski et al. ..... 242/56 A X
4,508,283 4/1985 Beisswanger ..... 242/56.4
4,550,882 11/1985 Hutzenlaub et al. ..... 242/56.6
4,749,140 6/1988 Ruff ..... 242/56.4

FOREIGN PATENT DOCUMENTS 1449664 12/1968 Fed. Rep. of Germany ..... 242/65

*Primary Examiner*—Stuart S. Levy
*Assistant Examiner*—Paul T. Bowen
*Attorney, Agent, or Firm*—Dirk J. Veneman; Raymond W. Campbell

[57] ABSTRACT

This invention pertains to web-slitting machines having automatic feed of empty roll cores to each winding station. The cores are inserted as a set from one side of the machine into troughs provided on separate feed beams located above the support roller or rollers on which rewinding takes place. Sequential cores are supported alternately by first and second troughs so that the cores are laterally offset, but still overlapped in radial cross section. The feed beams with troughs are pivotably mounted to move from above and between first and second sets of winding stations to a location near the winding stations where clamping pins from support arms are brought into engagement with the cores, for securing the cores for final positioning to commence winding.

19 Claims, 7 Drawing Sheets

CORE LOADING DEVICE FOR WEB-SLITTING MACHINES

BACKGROUND OF THE INVENTION i. Technical Field

This invention pertains generally to the field of web-slitting machines in which a large supply roll of web-like material, such as paper, is longitudinally slit into a plurality of narrower webs, with the narrower webs being subsequently rewound. More particularly, the invention pertains to an apparatus for effecting the change from a first set of cores or winding tubes having fully wound rolls thereon to a second set of empty cores for receiving the slit web.

ii. Prior Art

Two types of rewinding arrangements for web-slitting machines have been used widely in the past. In the first type, a support roller is present, and the roll cores, which are held by clamping pins of support arms, are disposed in contact with the support roller, at least at the beginning of coiling. The clamping pins are driven, to continuously rotate the cores during the rewinding process. Viewed in the longitudinal direction of the support roller, the cores for sequential narrow webs are positioned alternately in the right and left upper quadrants of the support roller.

The second type of rewinding arrangement commonly used for web-slitting machines is composed of two parallel support rollers placed at the same height, and winding takes place at the outer upper quadrant of each support roller. Clamping pins and support arms similar to those described previously are used to hold and rotate the roll cores. Again, viewed in the longitudinal direction of the support roller, the cores for sequential narrow webs are positioned alternately at the first and second support roller.

As the diameter of the rolls being formed begins to enlarge during the wind-up process in either of the afore-described arrangements, if the roll builds up under continuous contact with the support roller, the contact point with the support roller is essentially retained. However, it is also possible to wind up freely; i.e, after beginning the coiling, the roll being formed is lifted off the support roller by a small amount so that a free-running length of the narrow web running from the support roller to the roll being wound remains.

In either the single drum or double drum winder, it is important that the adjacent narrow rolls are formed alternately in first and second sets of winding stations as described. The reason for this is that the individual narrow webs are not significantly separated or displaced transversely to the web running direction; but at the same time, the narrow rolls being wound are held by support arms which protrude outwardly at the narrow roll ends, thus taking up space. If adjacent, narrow, partial webs are wound directly side-by-side, insufficient space is provided for the support arms. For this reason, adjacent narrow webs must be separated for rewinding in different sets of winding stations.

State-of-the-art web-slitting machines possess considerable winding speeds. Indeed, the working speed, i.e., the total time needed for processing a wide roll, e.g., a roll of paper machine width coming from the paper machine, into the appropriate number of narrow rolls, is significantly determined by the length of down time during which empty roll cores are being installed, the cores are tightened and connected to the ends of the partial webs, the webs are removed from the finished narrow rolls and the finished, wound, narrow rolls are removed from the web-slitting machine. Often, on web-slitting machines of this type, the cores are installed by hand and are glued or stapled to the ends of the narrow, partial webs. This work includes the danger of operating accidents, and, like all manual processes, it is time-consuming.

The present invention is based on the need to increase the working speed of web-slitting machines.

SUMMARY OF THE INVENTION

It is, therefore, one of the primary objects of the present invention to provide a web-slitting machine in which empty cores are properly installed quickly and efficiently, substantially reducing the time required for core placement as compared to previously-used core placement methods.

It is another object of the present invention to provide a web-slitting machine in which empty core insertion, core-to-web attachment, and finished roll removal is completed automatically, with minimal operator assistance, thereby substantially reducing the potential for accident and injury.

A further object of the present invention is to provide a web-slitting machine in which downtime from the completion of one winding operation to the start of a subsequent winding operation is minimized.

These and other objects are achieved in the present invention by providing, above the support roller or support rollers, between the sets of winding stations for the narrow rolls, and below the mount for the rider roller which presses the forming roll against the support roller, a type of trough for guiding and directing empty cores to automatic clamping apparatus for holding the cores.

It is possible to design the invention so that the single cores are moved in sequence, in order to be grasped by their particular clamping pins. However, the preferred design provides that a complete set of cores for one or both sets of winding stations, be moved simultaneously for all narrow rolls to be produced from the broad paper web. The set of cores can be prepared outside the web-slitting machine, and a change in width of the narrow webs being cut from the supply roll, and even the production of narrow rolls of different widths at one time, are easily accommodated. The support arms with the clamp pins and the rider roller are positioned automatically, according to the particular cutting program.

The cores can be pushed into the machine lengthwise from the side of the web-slitting machine, both for sequential, single introduction or for insertion of the complete set. In the latter case, separation and distribution of the sequential cores to the two sets of winding stations located at the outsides of the support roller or support rollers must occur. By preseparation of the cores in different troughs, the transfer to and grasping of cores by the clamping pins is promoted.

Neighboring troughs make it possible to install an entire set of cores while pushing all cores in from the side of the web-slitting machine. Preseparation is performed simultaneously by inserting the cores destined for a particular side of the support roller or rollers into the specific trough for that side. The cores are held by the troughs in such a manner that the cores in each trough protrude beyond the neighboring edges of the troughs, so that a core lying in a trough overlaps the region of a core lying in the other trough.

From the core loading position, the troughs are moved to a transfer position in which the clamping pins of the support arms grasp the cores. Movement of the trough from the loading position into the transfer position can be implemented in various ways, e.g., by suitable rails or guides. In the preferred, simplest and most reliable design the troughs are mounted on pivot arms.

As the trough is pivoted outwardly over the support roller or rollers, when switching from the core loading position into the transfer position, the cores must be positioned so that the particular core grasping apparatus for each core can properly align with the core. A yieldable stopper is provided for each core to hold the core in position for grasping. One stopper may have to hold a core in position by itself under some circumstances, and the core must not lose its alignment parallel to the support roller or to the axis of the clamping pin, even when only one stopper is in contact with the core. Thus, a certain contact length must be maintained, so that the core does not twist about an axis perpendicular to the core axis.

The stoppers can be pivot-mounted against spring tension on the outside of the trough, and pressed away by the support arms during transfer of the cores to the support arms. Such yieldable interference between a stopper and a support arm may occur as the support arm approaches a core generally perpendicularly to the core axis, or as the clamping pins are inserted longitudinally into a core.

The support arms for a core pivot into a position where the clamping pins remain located axially outside the core. By moving the support arms together, the clamping pins enter into the ends of the core. Proper angular orientation of the stoppers eliminates possible interference between the stopper and the stopper arms, except for the yielding interference required to move stoppers out of the way.

It is possible to combine the core feed device with the device used to sever the narrow webs after winding of a narrower roll has been completed. The outward motion of the trough can be used simultaneously to bring the cutting device into position, or conversely, bringing the cutting device into position can be used simultaneously for shifting the core feed device outwardly.

Additional objects and advantages of the present invention will be apparent from the detailed description and the accompanying drawings.

DETAILED DESCRIPTION OF THE PREFERRED EMBODIMENT

Figure 1:
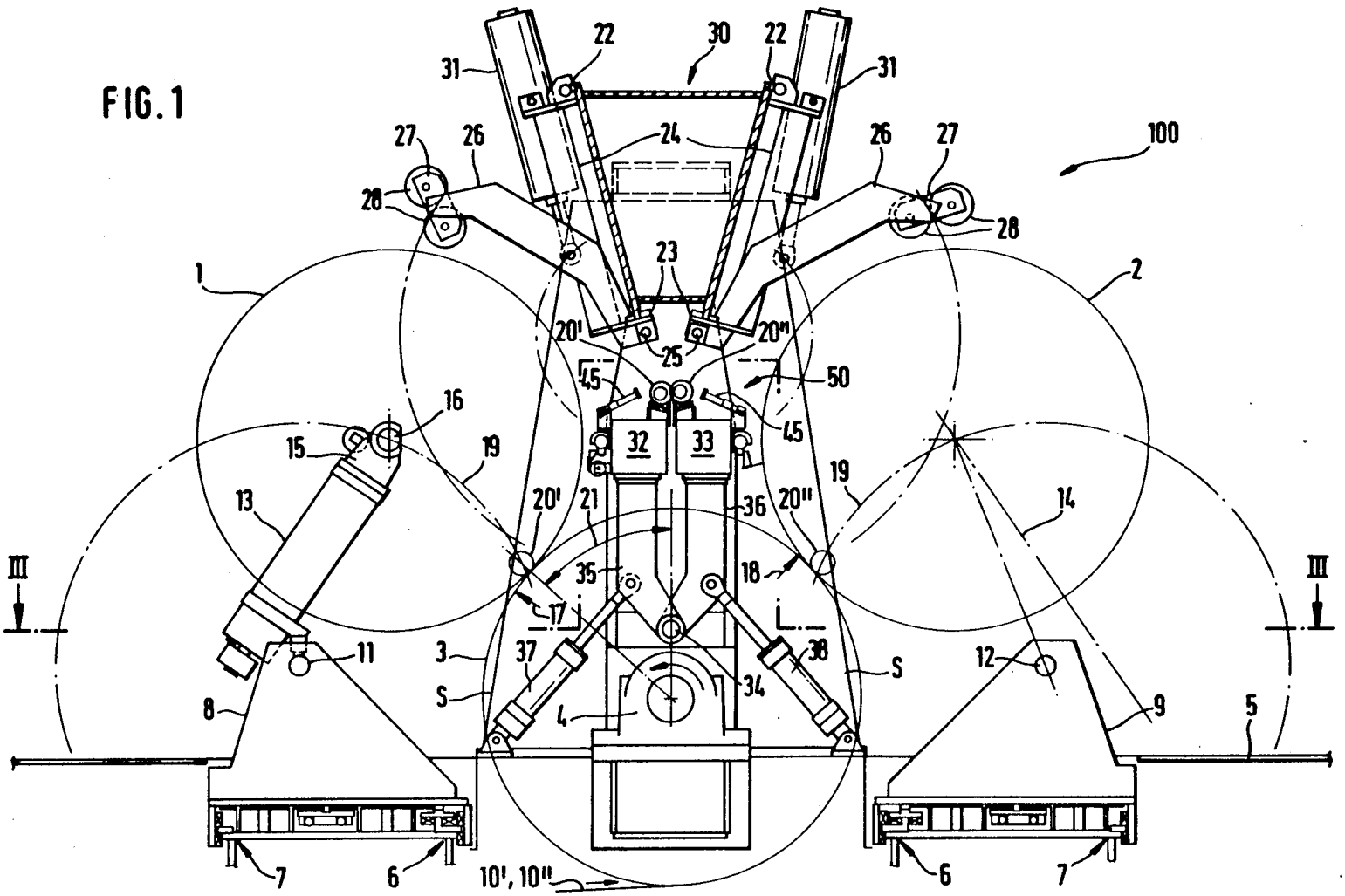
FIG. 1 is a side-elevational view of a first embodiment of a core loading device for a web-slitting machine according to the present invention.
Figure 2:
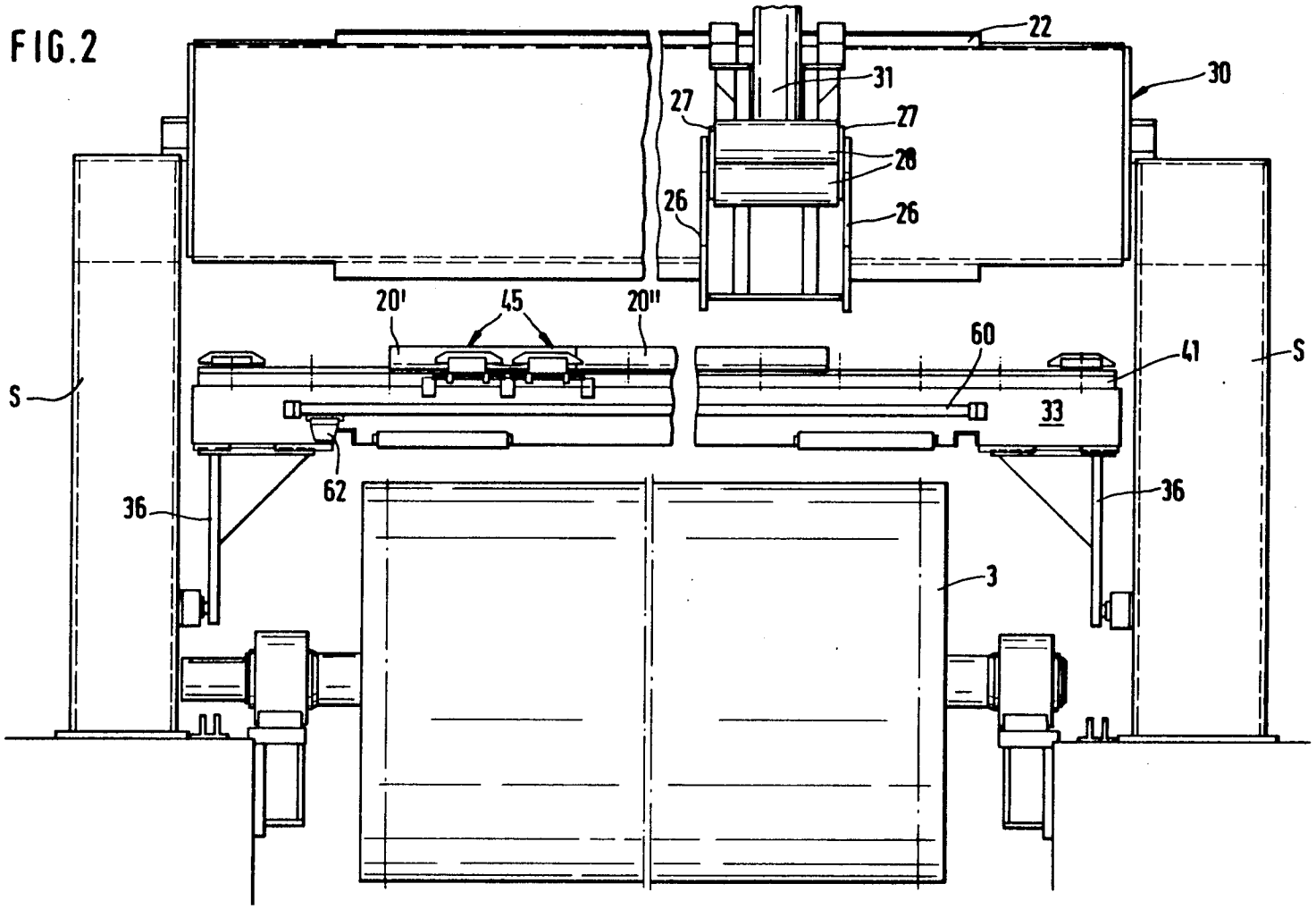
FIG. 2 is an elevational view of the embodiment shown in FIG. 1, taken from the right side of FIG. 1.

Referring now more specifically to the drawings, and to FIG. 1 in particular, a web-slitting machine 100 is shown, which incorporates the core loading device of the present invention. The web-slitting machine is used to divide a paper web the width of a paper machine into adjacent partial, narrower webs (10', 10'') which are wound up into narrow rolls (1, 2) of corresponding width. The actual slitting station is not shown, but will be well-known to those skilled in the art. The partial webs (10', 10''), which run in the direction of the arrow in the lower region of FIG. 1, have just left the cutting station and are moving to support roller (3), which is designed as a suction roller. The ends of partial webs (10', 10''), if they are cut at a point of the perimeter of support roller (3), can be held fast by the vacuum from the support roller. Support roller (3) is seated in a bearing block (4). Level (5) of the workshop floor is also denoted. The machine stand has an A-shape, and, on each end of support roller (3), there are two upright supports (S).

The length of support roller (3) equals the total width of partial webs (10', 10''). On each side of the support roller (3), and parallel thereto, is a straight guide rail or track (6, 7) extending the width of the machine. Skids (8, 9) are positionable parallel to the axis of support roller (3), and are movable along the guide rails or tracks (6, 7). Support arms (13, 14) are pivotal about axes parallel to the axis of the support roller; the support arms being mounted on pivot pins (11, 12) located in the area of the level of the axis of support roller (3). On the upper end of the support arms (see FIG. 1) core clamping heads (15) are disposed, each having a miter gear and a clamping pin (16) parallel to the axis of support roller (3). Through the miter gear, the clamping pin (16) can be driven about its axis by an electric or hydraulic motor (not illustrated).

The support arms are arranged in pairs, with the clamping pins of each pair being oppositely directed to hold roll cores therebetween. Thus, for each partial roll (1) or (2), there are two support arms (13) or (14) located on opposite ends of the roll, with clamping pins (16) from each arm facing each other and grasping the ends of the cores forming the rolls (1, 2).

Partial rolls (1) or (2) wound up from neighboring partial webs (10', 10'') are offset from each other in the longitudinal direction of support roller (3). This naturally applies also for support arm pairs (13, 13) or (14, 14) allocated to partial rolls (1) or (2), respectively.

Before beginning a wind-up process, partial webs (10' 10') are cut off and separated from preceding, finished, coiled, narrow rolls (1, 2). The end of partial web (10') lies, for example, in the region of arrow (17) and the end of partial web (10'') lies in the region of arrow (18). The ends of partial webs (10', 10'') are held fast on the periphery of the support roll by the suction effect from support roller (3). In general, more than two partial webs (10', 10'') are present. The ends of all partial webs (10') extending out to the left side of the support roller rest along a line generally in the region indicated by arrow (17) and the ends of all partial webs (10″) extending out to the right side of the support roller rest along a line generally in the region indicated by arrow (18).

By features to be described below, at the beginning of the winding process, fresh cores (20′, 20″), the lengths of which correspond to the widths of the partial rolls (1, 2) to be produced, are brought to the core transfer position indicated in FIG. 9. When support arms (13, 14) pivot, clamping pins (16) moves along an arc (19) (see FIG. 1) passing through the transfer position. The clamping pins (16) are aligned with particular cores (20′, 20″), and the pins are advanced into the ends of the cores to securely hold the cores. Support arms (13, 14) are then pivoted further inwardly, into the contact position, where the securely held cores (20′, 20″) come to rest on support roller (3), as indicated in FIG. 1. The contact position of the cores on the support roller, with respect to the vertical, forms an angle (21) of about 45 degrees, which is a greater angle as compared to known designs. Thus, greater spacing is provided between partial rolls (1, 2), the additional space being required for feed device (50), as explained below.

Cores (20′, 20″) each rest on the end of a partial web (10′, 10″) and are connected to the partial web. The cores have a gummed edge and are pressed by support arms (13, 14) with a certain pressure against the surface of support roller (3). The gum adheres to the paper, and the ends of partial webs (10′, 10″) begin to roll up onto the cores (20′, 20″) when clamping pins (16) are slowly accelerated.

At a distance above support roller (3), there is a support beam (30) extending over the width of the machine. The support beam has longitudinal guides (22, 23) with skids (24) sliding thereon along support beam (30) in a longitudinal direction. Each skid (24) has rider roll arms (26) pivoting about axes (25) parallel to the axis of support roller (3). The arms have, on their free ends, pivoting rider roll assemblies (27), each with two rider rollers (28) which can be brought by hydraulic cylinder (31) into contact with the outside of cores (20′, 20″). The rider roll assemblies function to secure the contact between the cores, support roll and webs, for satisfactory formation of the roll, especially in the initial winding phase.

In the area above support roller (3), between partial rolls (1, 2) and below support beam (30), there is a device (50) for automatic feeding of the empty cores. The feeding device is composed of two closely neighboring feed beams (32 33) disposed at the same height above support roller (3), parallel to it and extending along the entire length of the support roller. The beams are held by pivot arms (35, 36) pivotally mounted to a common bearing pin (34) near bearing block (4) of the support roller. Pivot arms (35, 36), with attendant feed beams (32, 33) can be pivoted outwardly over the top side of support roller (3) by operation of hydraulic cylinders (37, 38).

Figure 4:
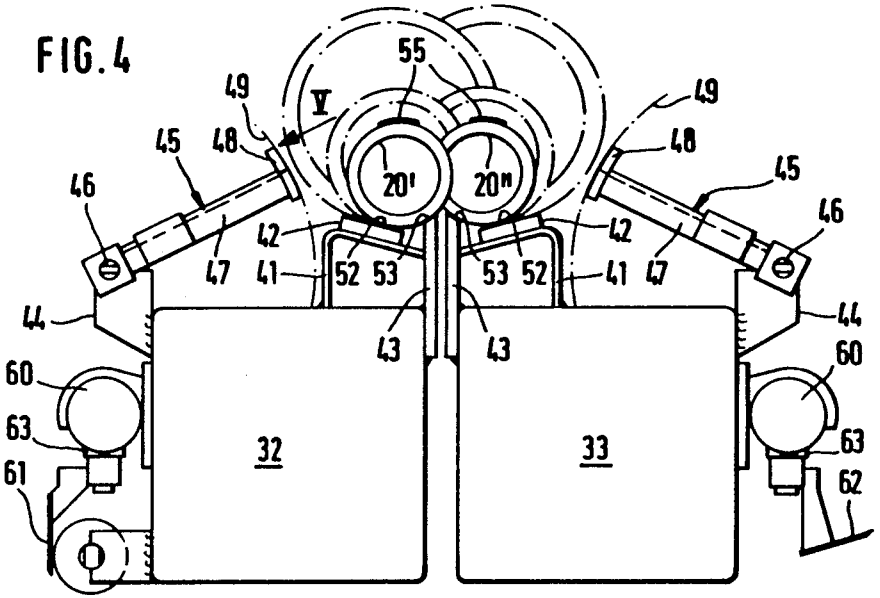
FIG. 4 is an enlarged end view of the area of the two core troughs in the device depicted in FIGS. 1 through 3.

The design of feed device (50) in the region of feed beams (32, 33) is shown on an enlarged scale in FIG. 4. Feed beams (32, 33) each consists of a rectangular, hollow member, and are placed so that the top sides thereof rest substantially horizontally in the position of FIG. 1. On the top sides, are support plates (42) on the upper surfaces of support housings 41 of the feed beams (32, 33). The support plates extend along the lengths of the feed beams (32) and (33) and are sloped toward each other. Vertical bars (43) are welded to the adjacent vertical sides of feed beams (32, 33); the bars extending upwardly at least to the elevation of support plates (42).

As seen in FIG. 4, support plate (42) and the upper edge of bar (43) passing along the length of feed beam (32, 33) form lines of contact (52, 53) for supporting cores (20′, 20″). The cores can be pushed along the lines of contact from one side of web-slitting machine (100) toward the other side thereof. Due to the support along two segments, the cores (20′, 20″) are found in the position indicated in FIG. 4 in a stable equilibrium. The sizing and plcement of various components are made so that the cross sections of core (20′) or (20″) resting on left support plate (42) and on right support plate (42) overlap in the manner visible in FIG. 4. If alternating left and right cores (20′) or (20″) are supplied, the entire set of cores can be pushed into position merely by sliding the cores in from the end, even though the sequential cores are braced alternately against feed beam (32) and against feed beam (33).

The core support apparatus described above is equally suited for cores of greater diameter, as indicated by dashed lines in FIG. 4.

Gummed sections (55) or adhesive strips are applied on cores (20′, 20″) outside web-slitting machine (100), and attachment of cores to the ends of partial webs (10′, 10″) can be performed automatically.

Figure 5:
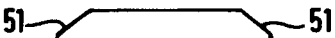
FIG. 5 is a view of the front side of a core stopper for the device shown in FIG. 4, the view being taken in the direction of the arrow V in FIG. 4.

At the sides of feed beams (32, 33) located in the outboard direction from the feed beams, stoppers (45) can be pivoted up and down. The stoppers are attached at bearing blocks (44), and are pivotal around axes (46). The stoppers are held by spring force in the normal position shown in FIG. 4, but can be pressed downwardly, overcoming the spring force, onto the top side of feed beams (32, 33). The stoppers comprise arms (47) directed against cores (20′, 20″) A contact plate (48) on the end of arm (47) has a curved surface (49) coaxial to axis (46). In direction V (see FIG. 4), contact plates (48) have the outline shown in FIG. 5, i.e., they are essentially rectangular, but slanted to the upper corners at (51).

Figure 6:
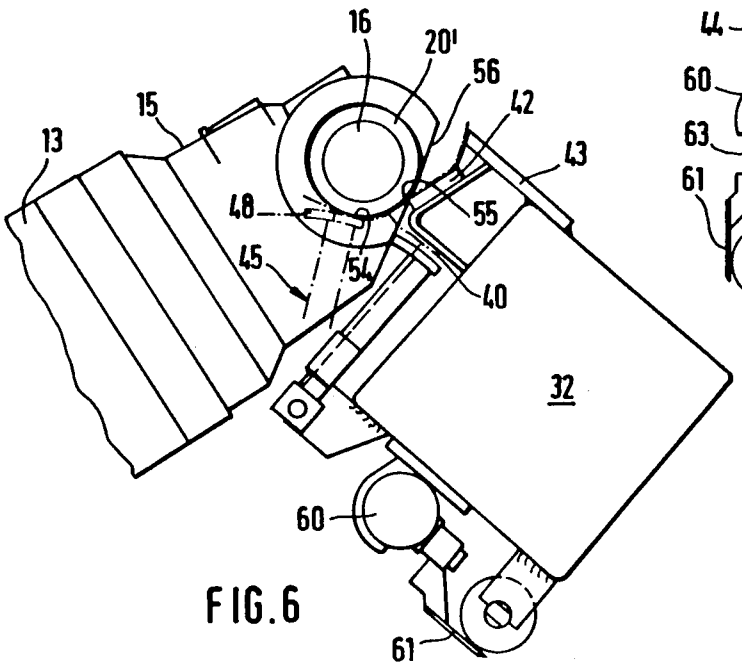
FIG. 6 is an end view of the left transfer beam of the device shown in FIG. 4, but showing the beam in the core transfer position.

When feed beams (32, 33) are pivoted into the transfer position, left feed beam (32) comes to the position illustrated in FIG. 6. Core (20′) begins to roll over support plate 42 to the left, and comes to rest at contact plate (48) of stopper (45). During movement from the core loading position shown in FIG. 4, cores (20′, 20″) undergo a change in balance position from being supported along lines (52, 53), to being supported along lines (54, 55) as shown in FIG. 6. In both states, the cores are held in a defined position.

Parts (42, 43) and (48) together form a trough (40) indicated by a dashed line in FIG. 6. A mirror-image trough is formed at right feed beam (44). Troughs (40, 40) of beams (43, 44) are close neighbors, and are bounded on the facing or adjacent sides by vertical bars (43) which form contact lines (53) in the position of FIG. 4. Cores (20′, 20″), which have a circular cross section, rest against bar (43) from above, and, as seen in FIG. 4, the cores extend for geometric reasons beyond bar (43) toward the other feed beam. Thus, in the upright, core loading position of feed beams (32, 33), as shown in FIG. 4, cores (20′, 20″) overlap, and sequential cores (20′, 20″) contact each other in the axial direction. As the cores move to the transfer position shown in FIG. 6, defined positions of core (20′, 20″) sets are established on the right and left, with sequential cores within each set being spaced from each other by the length of the core from the other core set which was positioned therebetween in the position of FIG. 4. The spacing between cores is established so that clamping pins (16) at support arms (13, 14) can enter the ends of cores (20', 20") without interferring with adjacent cores.

Figure 3:
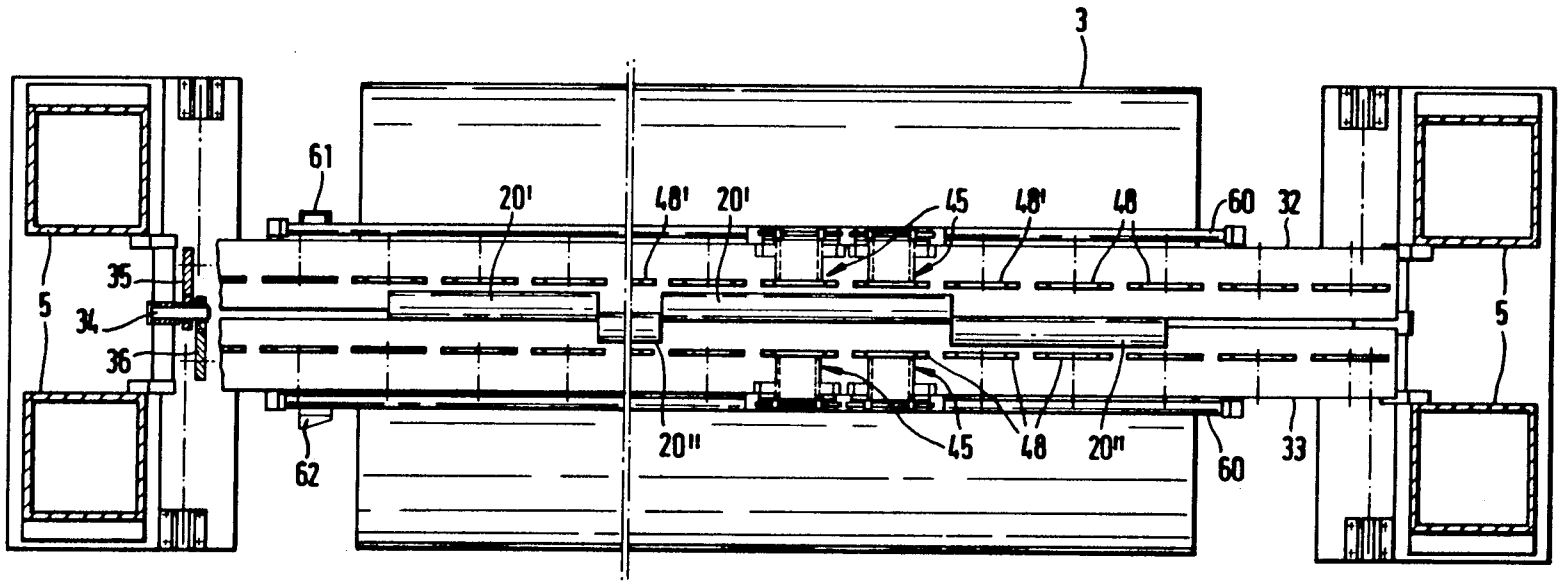
FIG. 3 is a cross-section view of the core loading device shown in FIG. 1, taken along line III—III of FIG. 1.

The placement of feed beams (32, 33) with stoppers (45) is shown from above in FIG. 3. Stoppers (45) in entirety are shown only in the middle, while the other stoppers are indicated only by their contact plates (48), and are otherwise indicated only by dashed lines representing the midline of each. Thus, on each side there is a series of stoppers (45) and contact plates (48) in substantial alignment. The width of each stopper is selected so that, in the preferred arrangement, at least three stoppers contact a core even for the shortest occurring length of core (20', 20"). The reason for this is best explained with reference to FIG. 6. If feed beam (43) is in the transfer position, and the two support arms provided for core (20') are moved into position, then, in the case of middle core (20') in FIG. 3, the support arms would come to rest with their undersides (54) on two stoppers (45), whose contact plates are indicated as (48') in FIG. 3. These two stoppers are pressed downwardly, in the manner visible in FIG. 6, against spring force so that the upper edge of each comes to rest under trough (40) or contact (42). In the region between support arms (13, 13), stoppers (45) are not pressed down, but remain in their normal position, and the core (20') continues to be braced in the manner shown in FIG. 6 while the grasping by clamping pins (16) occurs. If stoppers (45) were longer, or if the stoppers were pressed down along the entire length of core (20'), then, in the position shown in FIG. 6, core (20') would roll down and fall between support arms (13, 13) before it could be grasped by clamping pins (16).

In the illustrated example, three stoppers (45) are provided along the length of middle core (20'). It is sufficient if only one stopper (45) remains present in the illustrated transfer position of FIG. 6 for each core, provided, however, the stopper has a length in the direction of the axis of support roller (3) of about fifty percent (50%) of the length of the shortest core, in order to guide the cores (20') in an axis-parallel position, while not interfering with the support arms (13, 14).

Insertion of clamping pins (16) into the ends of the cores occurs through corresponding shifting of support arms (13, 14) along rails (6, 7). In order to keep the support arms from striking the front sides of stoppers, the stoppers are angled as shown at (51) in FIG. 5, by which stopper (45) can also be pressed away upon the axial approach of a support arm.

As shown most clearly in FIG. 4, cutting blades (61, 62) are located at the outside of feed beams (32, 33), and the blades can be moved over the width of the web-slitting machine by means of pneumatic cylinders (60) extending along the length of feed beams (32, 33). Pistonless pneumatic cylinders, known to those in the art, in which the stroke of moving element (63) can occur over the entire length can be used. Cutting blades (61, 62) are not of symmetrical design and placement, in that the cutting points are not located symmetrically in the web-slitting machine.

Figure 7:
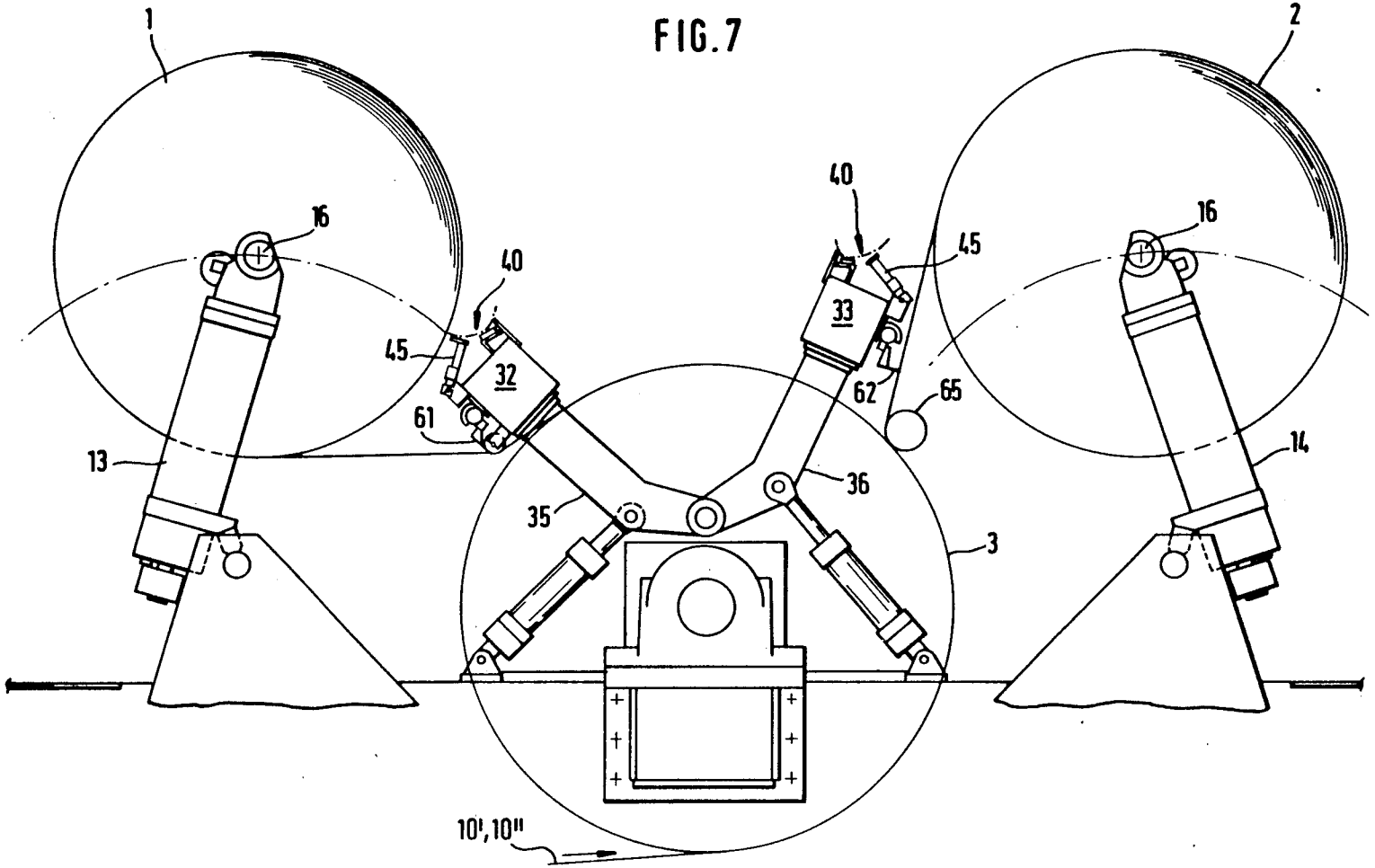
FIGS. 7, 8, and 9 are simplified end-elevational views showing sequential working phases of the core loading device shown in FIGS. 1 through 6.
Figure 8:
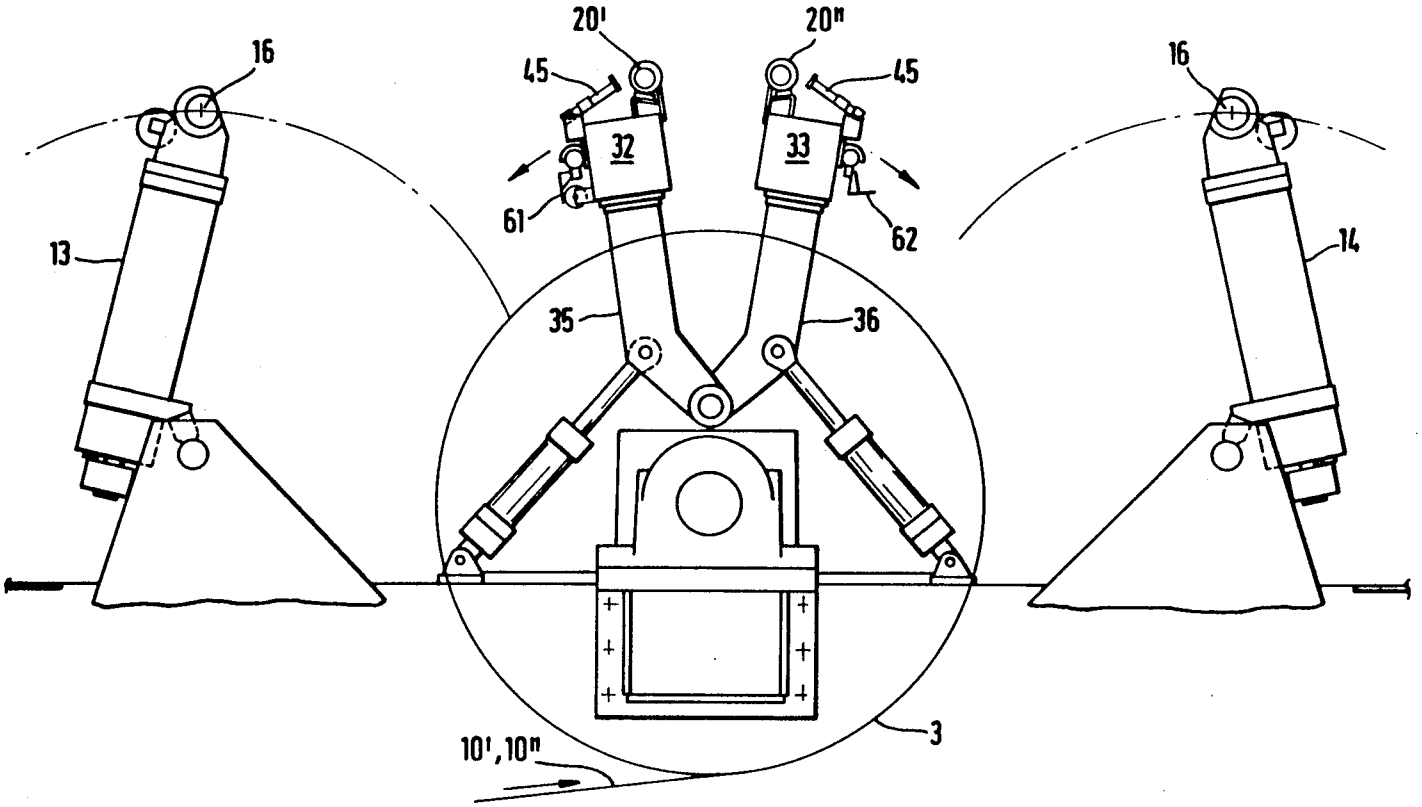

FIG. 7 shows the operation of the device when cutting by blades (61, 62) is occurring. Narrow rolls (1, 2) are completed, and are moved outwardly after the narrow webs are severed. On the right side of FIG. 7, web (10") is held by a clamping rod (65) in proper position to be severed. After severing, the ends of partial webs (10', 10"), which remain partially coiled around support roller (3), are held securely by support roller (3) due to the suction effect. Feed beams (32, 33) then pivot upwardly into the position shown in FIG. 1, where the the sets of cores (20', 20") are loaded with sequential cores being placed alternately on the right and left troughs. As soon as cores are inserted into troughs (40), feed beams (32, 33) move apart in the manner indicated in FIG. 8, and cores (20') held in left trough (40) move left; while those cores (20") in right trough (40) are carried to the right.

Figure 9:
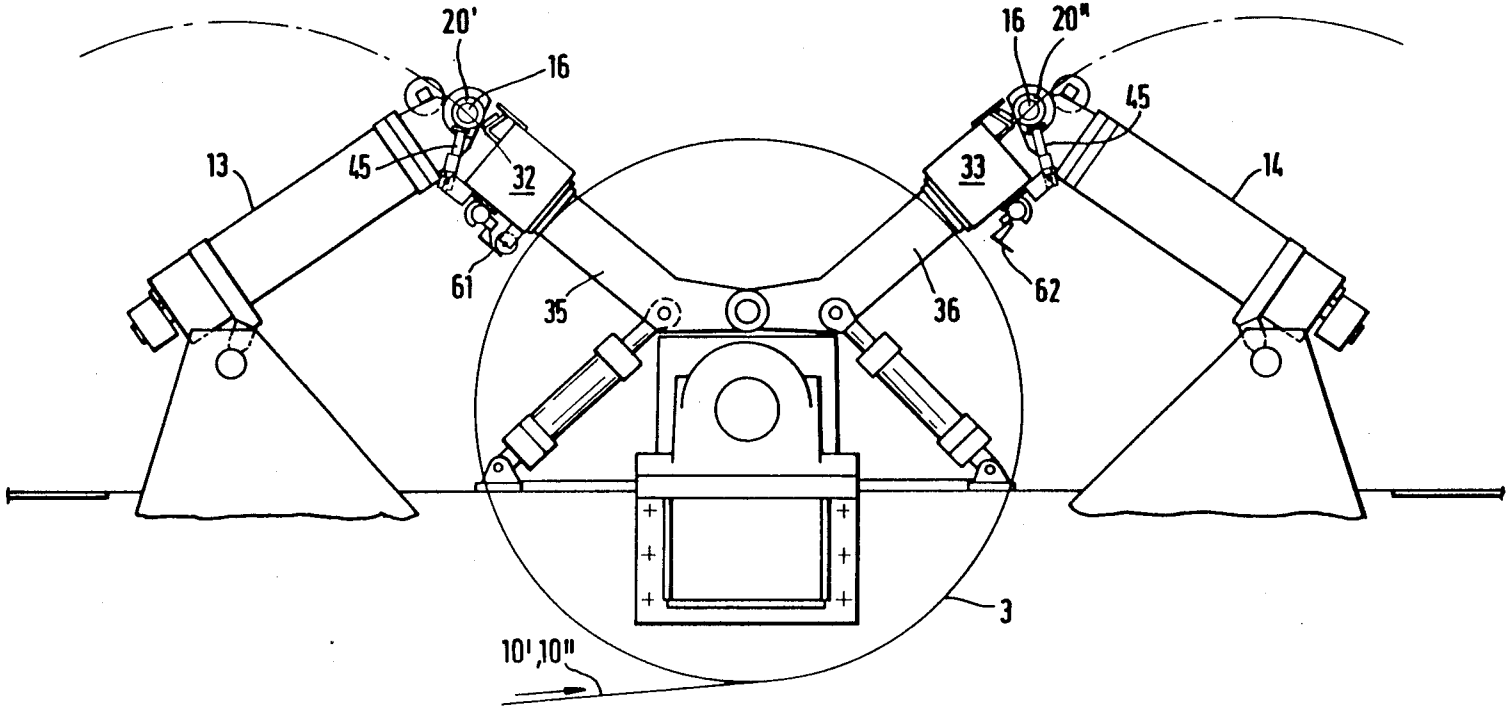

In FIG. 9, feed beams (32, 33) have reached their end position, i.e., the transfer position. Cores (20', 20") are located in a position as shown in FIG. 6 and are grasped and clamped by clamping pins (16) of support arms (13) or (14).

Next, support arms (13) move slightly counterclockwise, and support arms (14) move slight clockwise, whereupon feed beams (32, 33) pivot upward out of the way. Support arms (13, 14) pivot inwardly until cores (20', 20") contact support roller (3) in a line or region covered by the ends of narrow webs (10', 10"). The cores are affixed to the web ends, and the wind-up can then begin.

Figure 10:
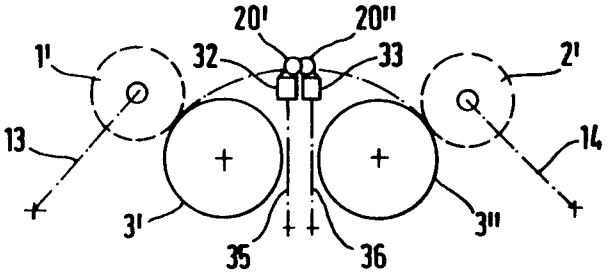
FIG. 10 is a schematic drawing of another embodiment of the invention, for use of the invention in a design having two support rollers.

In FIG. 10, a second embodiment of the present invention is illustrated schematically. The web-slitting machine has two support rollers (3', 3") which can be supplied with cores (20', 20") in practically the same manner as previously described. Wind-up of single rolls (1', 2') takes place in the upper outer regions or quadrants of the support rollers (3', 3").

While two embodiments of a web-slitting machine of the present invention have been shown and described in detail herein, various additional changes may be made without departing from the scope of the invention defined in the following claims.

I claim:

1. A web-slitting machine of the type wherein a wide web is unrolled from a wide supply roll, the web being longitudinally divided into a plurality of narrower webs at a cutting station, and the narrower webs then being rewound into a plurality of smaller, narrower rolls, said machine comprising:

at least one support roller for receiving the narrower webs from the cutting station and about which the narrower webs are partially wrapped;

a plurality of winding stations positioned at the periphery of the at least one support roller for operating in conjunction therewith to wind the smaller narrower rolls, one such winding station being provided for each smaller, narrower roll to be wound, and a plurality of such winding stations forming a set of winding stations, each station of each set being in substantial alignment along an axis parallel to the axis of the support roller in conjunction with which it operates, stations for adjacent narrower webs being in different sets;

a pair of parallel support arms for each winding station, said support arms being pivotally mounted on one end about an axis parallel to the axis of the support roller with which it operates; said arms having on the other, nonpivotally mounted end rotary driven clamping pins, the pins from the arms of each pair being disposed in facing relationship and rotatable about an axis parallel to the axis of the support roller, said pins being adapted for grasping therebetween a core adapted for receiving a narrower web to be wound thereon;

a feed device provided for each set of said winding stations, said feed device including trough means for each set of winding stations for holding a set of cores for each set of winding stations and transport means for moving said trough means from a first core-loading position in which cores are loaded into the trough means to a second transfer position in which the cores are presented in a manner permitting automatic grasping by said clamping pins between the arms of each pair of parallel support arms; and said trough means being adapted for receiving, in sequentially alternating series, cores for alternate sets, said cores being inserted lengthwise at an end of said trough means, said cores for alternate sets of winding stations overlapping in radial cross-section during lengthwise insertion.

2. A web-slitting machine as defined in claim 1 in which said trough means includes adjacent troughs extending centrally above first and second sets of winding stations, said troughs being so closely disposed in said core-loading position that cores positioned in said troughs in said core-loading position partially overlap in radial cross section.

3. A web-slitting machine as defined in claim 2 in which said troughs are disposed on beams extending over the width of said web-slitting machine.

4. A web-slitting machine as defined in claim 3 in which web severing means are provided on said beams for severing the webs in a cross machine direction.

5. A web-slitting machine as defined in claim 2 in which each of said troughs includes core support means for holding cores in a first securely balanced position during core loading and in a second securely balanced position during core transfer from said feed device to said support arm pairs.

6. A web-slitting machine as defined in claim 5 in which said troughs include yieldable support means for supporting cores in said core transfer position, said yieldable support means being adapted for yielding interference with said support arms.

7. A web-slitting machine as defined in claim 1 in which said support arm pairs hold cores against said support roller at an angle of about 45° from vertical.

8. A web-slitting machine as defined in claim 1 in which a single support roll is provided, first and second sets of winding stations are disposed in upper quadrants of said winding drum; and said feed device is positioned centrally above and between said first and second sets of winding stations.

9. A web-slitting machine as defined in claim 1 in which first and second support drums are provided having parallel axes in a horizontal plane; first and second sets of winding stations are disposed in the outer, upper quadrants of the first and second support drums, respectively, and said feed device is disposed centrally above and between said first and second winding drums.

10. In a web-slitting machine of the type in which a supply roll of web-like material is unwound, longitudinally slit in a cutting station to form a plurality of narrower webs, and said webs are rewound into smaller, narrower rolls on roll cores disposed in winding stations, said winding stations having a pair of support arms for each core, said arms including clamping means for each end of the core held therein, and means for rotating said cores; the improvement comprising:

a core feed device for supplying empty cores to said winding stations, said core feed device including core holding apparatus for receiving and holding cores loaded therein, and transport means for moving said apparatus from a core-loading position to a core-transfer position in which cores are grasped by said support arm pairs;

said core feed device including a plurality of troughs for receiving and holding sets of cores and a plurality of transport means for providing a set of cores simultaneously to a plurality of sets of winding stations in spaced locations;

said troughs being adapted for receiving cores at one end thereof; and having support surfaces accommodating lengthwise movement of cores therein; and said troughs being closely disposed in a core loading position such that cores placed in one of said troughs in said core loading position partially overlap in radial cross section with cores placed in another of said troughs in said core loading position.

11. The improvement defined in claim 10 in which said core feed device includes a plurality of trough means for receiving and holding cores and a plurality of transport means for providing a set of cores simultaneously to a plurality of sets of winding stations in spaced locations.

12. The improvement defined in claim 10 in which said core holding apparatus includes trough means adapted for receiving cores at one end thereof, and in which support surfaces of said trough means accommodate lengthwise movement of cores therein.

13. The improvement defined in claim 10 in which said core feed device includes adjacent troughs extending centrally above first and second sets of winding stations, said troughs being closely disposed in a core loading position such that cores placed in said troughs in said core loading position partially overlap in radial cross section.

14. The improvement defined in claim 10 in which said core holding apparatus includes core support means for holding cores in a first securely balanced position during core loading, and in a second securely balanced position during core transfer.

15. The improvement defined in claim 14 in which said core support means for said second securely balanced position includes apparatus adapted for yielding interference with support arms of the winding stations.

16. A web-slitting machine of type wherein a wide web is unrolled from a wide supply roll, the web being longitudinally divided into a plurality of narrower webs at a cutting station, and the narrower webs then being rewound into a plurality of smaller, narrower rolls, said machine comprising:

at least one support roller for receiving the narrower webs from the cutting station and about which the narrower webs are partially wrapped;

a plurality of winding stations positioned at the periphery of the at least one support roller for operating in conjunction therewith to wind the smaller narrower rolls, one such winding station being provided for each smaller, narrower roll to be wound, and a plurality of such winding stations forming a set of winding stations, each station of each set being in substantial alignment along an axis parallel to the axis of the support roller in conjunction with which it operates, stations for adjacent narrower webs being in different sets;

a pair of parallel support arms for each winding station, said support arms being pivotally mounted on one end about an axis parallel to the axis of the support roller with which it operates; said arms having on the other, nonpivotally mounted end rotary driven clamping pins, the pins from the arms of each pair being disposed in facing relationship and rotatable about an axis parallel to the axis of the support roller, said pins being adapted for grasping therebetween a core adapted for receiving a narrower web to be wound thereon;

a feed device provided for each set of said winding stations, said feed device including trough means for holding a set of cores and transport means for moving said trough means from a first core-loading position in which cores are loaded into the trough to a second transfer position in which the cores are presented in a manner permitting automatic grasping by said clamping pins between the arms of each pair of parallel support arms; and said trough means including adjacent troughs extending centrally above first and second sets of winding stations, said troughs being so closely disposed in said core loading position that cores positioned in said troughs in said core loading position partially overlap in radial cross section, said troughs having core support means for holding cores in a first securely balanced position during core loading and in a second securely balanced position during core transfer from said feed device to said support arms, said troughs further including yieldable support means for supporting cores in said core transfer position, said yieldable support means being adapted for yielding interference with said support arms, said yieldable support means including a series of core stoppers positioned along said beams and said core stoppers each being spring mounted for yielding to pressure exerted by said support arms.

17. A web-slitting machine as defined in claim 16 in which at least three of said stoppers are provided for each core supplied by said core feed device.

18. A web-slitting machine as defined in claim 16 in which a stopper shorter than the length of the core held thereby is provided for each core and is disposed intermediate the ends of said core.

19. A web-slitting machine as defined in claim 16 in which said stoppers include angularly disposed surfaces for interfering with and yielding to said support arms when said support arms are moved in a longitudinal direction.

* * * * *

UNITED STATES PATENT AND TRADEMARK OFFICE

CERTIFICATE OF CORRECTION

PATENT NO. : 4,951,900

DATED : August 28, 1990

INVENTOR(S) : Bernd Goerner

It is certified that error appears in the above—identified patent and that said Letters Patent is hereby corrected as shown below:

| | |
|---|---|
| Column 3, Line 37: | Please delete "stopper" second occurrence and insert therefor --support--. |
| Column 4, Line 59: | Please delete "10'" and insert therefor --10"--. |
| Column 5, Line 9: | Please delete "moves" and insert therefor --move--. |
| Column 7, Line 53: | Please delete "outside" and insert therefor --outsides--. |
| Column 10, Line 14: | Please delete ";" and insert therefor --,--. |

Signed and Sealed this

Third Day of March, 1992

*Attest:*

HARRY F. MANBECK, JR.

*Attesting Officer*

*Commissioner of Patents and Trademarks*